United States Patent [19]

Tsai

[11] Patent Number: 5,070,669

[45] Date of Patent: Dec. 10, 1991

[54] HEAT-INSULATION AND WATER-PROOFING BRICK BOND

[76] Inventor: Chang Tsai, No. 224, Chung Hua Road, Chi Chia Village, Shen Kan Hsiang, Changhua, Taiwan

[21] Appl. No.: 624,600

[22] Filed: Dec. 10, 1990

[51] Int. Cl.[5] ..... E04C 1/00; E04B 5/00

[52] U.S. Cl. ..... 52/309.12; 52/309.8; 52/309.17; 52/408; 52/579

[58] Field of Search ..... 52/309.8, 309.12, 309.17, 52/408, 579, 320, 509, 513, 258, 471, 199, 460

[56] References Cited

U.S. PATENT DOCUMENTS

| | | | |
|---|---|---|---|
| 4,486,995 | 12/1984 | Allen et al. | 52/309.8 |
| 4,530,193 | 7/1985 | Ochs | 52/309.8 X |
| 4,651,494 | 3/1987 | Van Wagoner | 52/199 X |
| 4,942,707 | 7/1990 | Huettemann | 52/309.12 X |

*Primary Examiner*—Richard E. Chilcot, Jr.
*Assistant Examiner*—Robert Canfield
*Attorney, Agent, or Firm*—Bacon & Thomas

[57] ABSTRACT

For roofing construction, a heat-insulation and water-proofing brick bond of the type comprising a plurality of rectangular heat-insulation bricks longitudinally and latitudinally aligned and firmly connected together by at least a binding member. The binding member is shaped like a channel bar, having two opposite leg portions extending from a flat top portion for fastening in corresponding grooves formed on the top edge at the four sides of the rectangular heat-insulation bricks, permitting the flat top portion to fit flush with the topmost edge of the rectangular heat-insulation bricks, so that the gap between each two rectangular heat-insulation bricks is covered against permeation of water.

7 Claims, 3 Drawing Sheets

HEAT-INSULATION AND WATER-PROOFING BRICK BOND

BACKGROUND OF THE INVENTION

1. Field of the Invention

The present invention relates to brick bonds, and more particularly relates to a heat-insulation and water-proofing brick bond which is easy to set up and can effectively protect against heat transmission or water permeation.

2. Description of Prior Art

In conventional roofing construction, roofing cement is polished and coverd with a layer of roofing felt or PU sheet for protection against permeation of water, and then, a brick bond or foamed concrete is set on the top to resist against heat transmission. This conventional roofing construction procedure is complicated and expensive to perform. At the same time, it gives a heavy load to the roof of a building.

SUMMARY OF THE INVENTION

The present invention is to provide a heat-insulation and water-proofing brick bond for roofing construction, which is easy and inexpensive to install and can effectively protect against heat transmission and water permeation.

The present invention is to use binding members to bind up a plurality of rectangular heat-insulation bricks which are longitudinally and latitudinally aligned. The rectangular heat-insulation bricks are each comprised of a rectangular outer shell defining therein a frog for holding an inner heat-insulation layer and sealed by an outer sealing layer. A binding member in accordance with the present invention is shaped like a channel bar, having two opposite leg portions extending from a flat top portion for fastening in corresponding grooves made on the top edge at the four sides of the rectangular heat-insulation bricks, permitting the flat top portion to fit flush with the topmost edge of the rectanglar heat-insulation bricks. Therefore, heat transmission is prohibited by the bricks, and the gap between each two heat-insulation bricks is protected by the binding members against permeation of water.

BRIEF DESCRIPTION OF THE DRAWINGS

The foregoing and other objects, features and advantages of the present invention will be best understood from the following description, the appended claims and the accompanying drawings in which:

DETAILED DESCRIPTION OF THE PREFERRED EMBODIMENT

Figure 1:
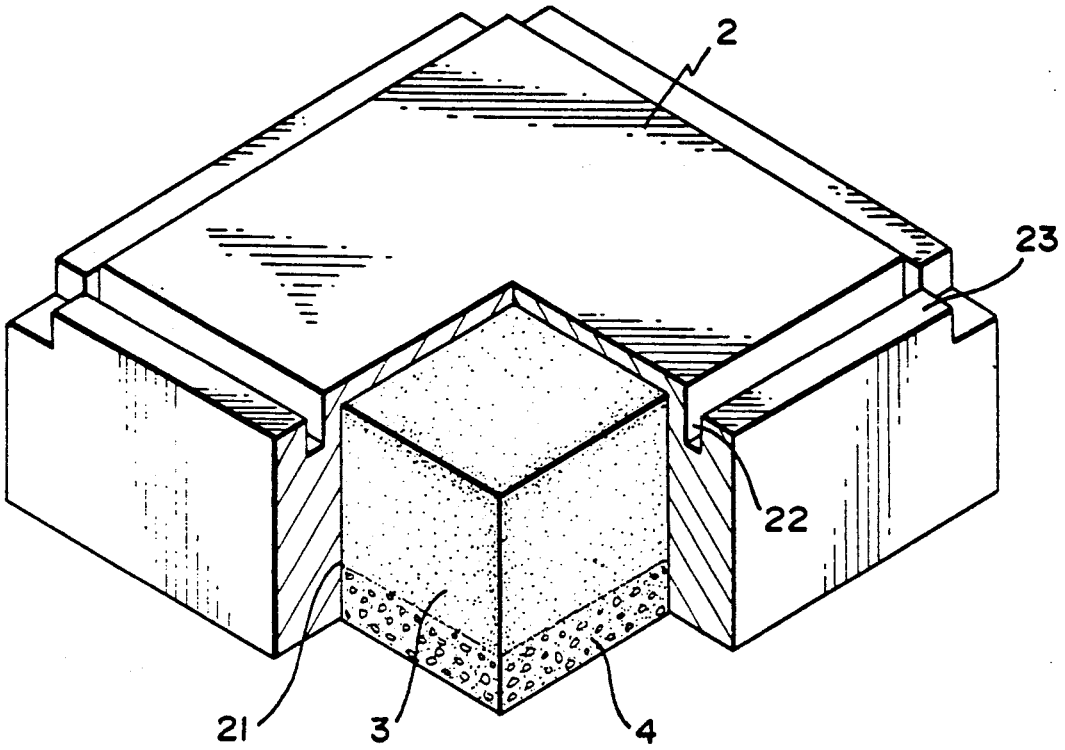
FIG. 1 is a perspective and partly sectional view of a heat-insulation brick constructed according to the present invention.

Referring to FIG. 1, a heat-insulation brick in accordance with the present invention is generally comprise of outer shell 2, inner heat-insulation layer 3, and outer sealing layer 4. The outer shell 2 is made of reinforced plastics in rectangular shape, defining therein a cavity

21 for holding one or more heat-insulation layers 3 and sealed by an outer sealing layer 4. It comprises four elongated grooves 22 and four elongated projecting strips 23 at the top around the four side edges thereof, wherein the topmost edge of the elongated projecting strips 23 is slightly lower than the topmost edge of the outer shell 2. The heat-insulation layer 3 is made of high density foamed plastics, and most preferably made of high density polyrone. The outer sealing layer 4 is to seal heat-insulation layers 3 in the frog 21 of the outer shell 2. It can be made of concrete or other suitable covering materials.

Figure 2:
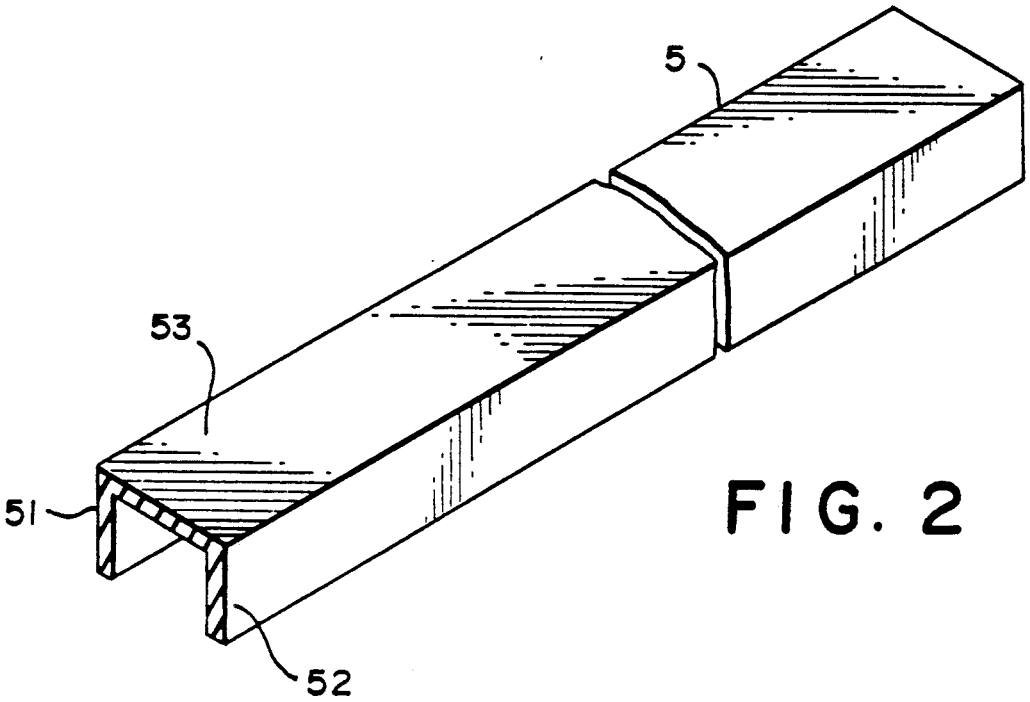
FIG. 2 illustrates an elongated, U-shaped binding member according to the present invention.

During brick bonding, binding members 5 are used to tie up the bricks. As shown in FIG. 2, a binding member 5 is substantially shaped like a channel bar, having two opposite leg portions 51 and 52 extending from a flat top portion 53, wherein the leg portions 51 and 52 are respectively made in thickness approximately equal to the width of the grooves 22 and in height approximately equal to the height between the inner bottom of the grooves 22 to the topmost edge of the outer shell 2, the flat top portion 53 is made in thickness approximately equal to the level difference between the topmost edge of the outer shell 2 and the topmost edge of the projecting strips 23. Therefore, when two rows of heat-insulation bricks are arranged side by side, the binding member 5 can be fastened in position with its two leg portions 51 and 52 respectively inserted in corresponding two rows of grooves 22, top firmly secure the two rows of heat-insulation bricks together. After binding, the binding member 5 fits flush with the topmost edge of the heat-insulation bricks (see FIG. 4), and the gap between each two bricks is protected by the binding member 5 against permeation of water.

Figure 3:
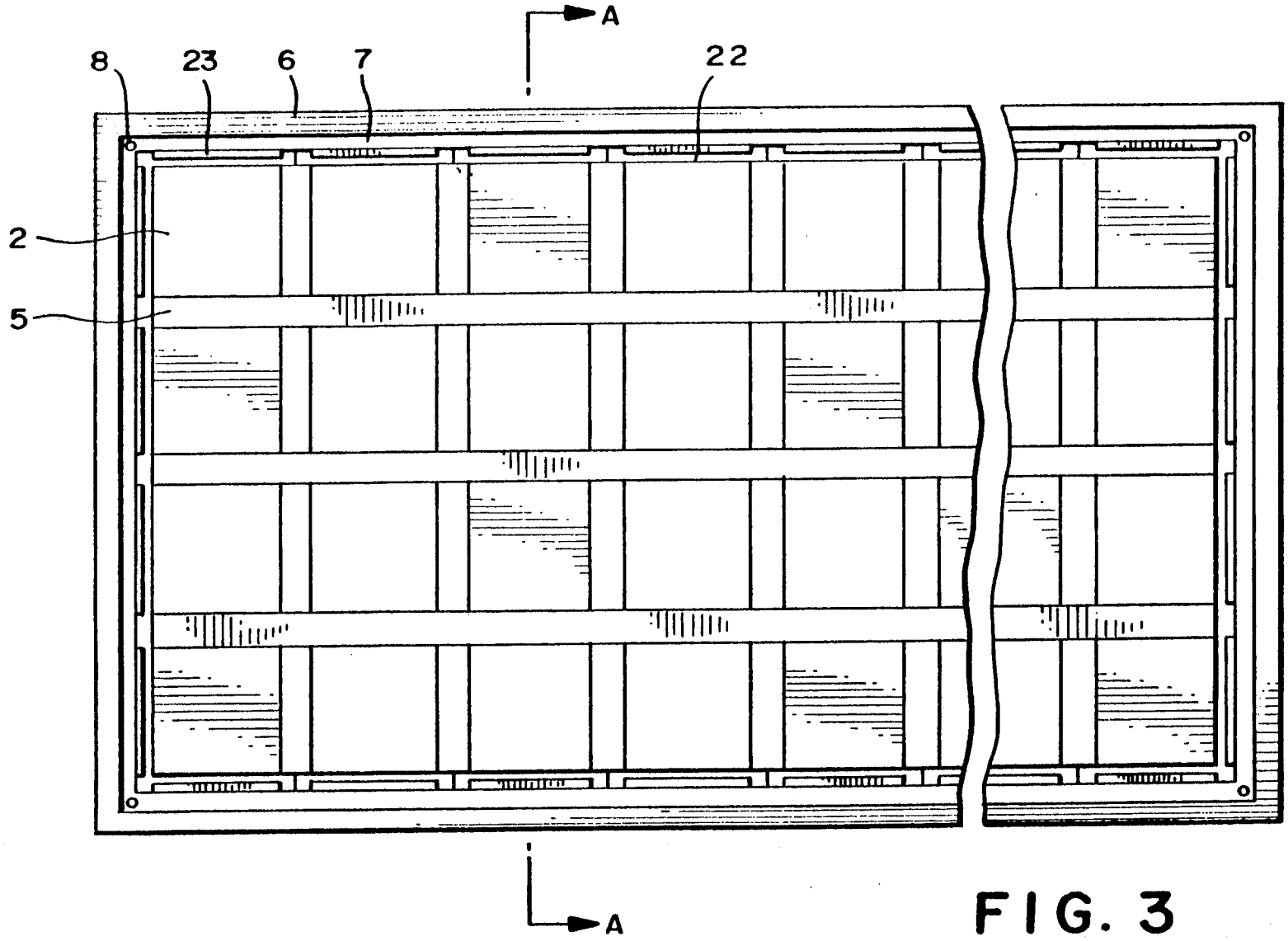
FIG. 3 is a plan view illustrating a heat-insulation and water-proofing brick bond on a roof according to the present invention.
Figure 4:
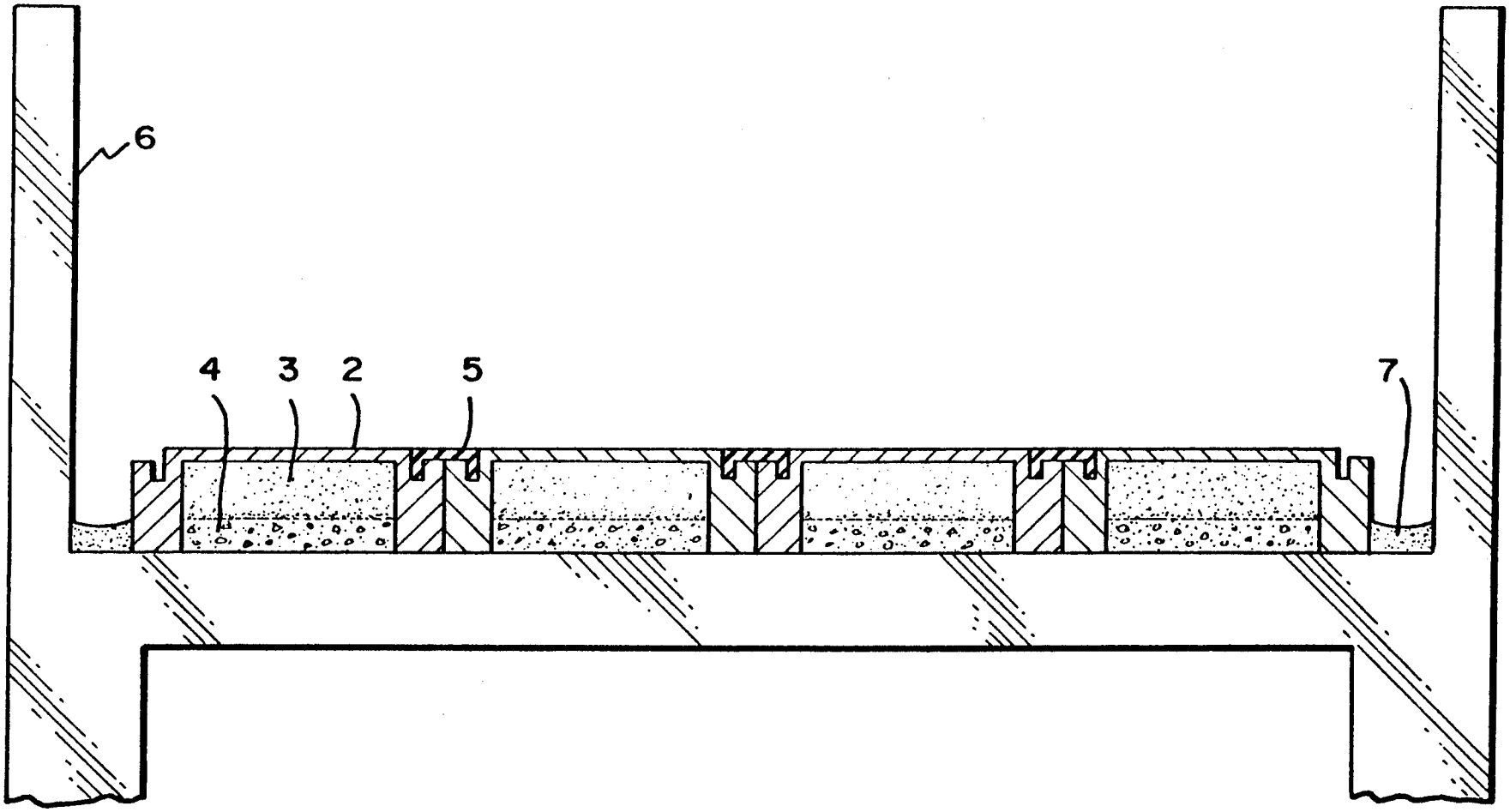
FIG. 4 is a sectional view taken on line A—A of FIG. 3.

Brick bond of the present invention is processed and outlined hereinafter, with reference to FIGS. 3 and 4. Heat insulation bricks are arranged together, and longitudinally and latitudinally aligned. A plurality of binding members 5 are respectively fastened in the grooves 22 of each two longitudinal and latitudinal rows of insulation bricks to firmly bind up the bricks into a stright bond. As shown in FIG. 3, binding members 5 are continuous in the longitudinal direction and are each of brick length in the latitudinal direction. After the brick bond is formed, a water gutter 7 is made around the brick bond within the surrounding wall 6 for guiding rain water to drain through drain holes 8. In order to ensure water effect, sealing material (for example, silicon resin) is used to seal the gaps between the longitudinal and latitudinal binding members 5 or any other gaps which are not covered by the binding members 5.

I claim:

1. A heat-insulation and water-proofing brick bond comprising:

a) a plurality of rectangular bricks longitudinally and latitudinally aligned;

b) at least one binding member connecting the bricks together;

c) each brick including a rectangular outer shell defined by a top surface and a cavity formed therein, the outer shell being provided with four elongate grooves extending along four sides of the top surface, each groove being partly defined by a projecting strip having a top edge disposed below the top surface of the outer shell;

d) an inner heat insulation layer disposed in each cavity and an outer sealing layer sealing the inner layer;

e) the binding member being in the configuration of a channel bar defined by a flat top portion and a pair of opposed leg portions extending from the flat top portion; and f) the leg portions of the binding member being engaged within adjacent elongate grooves of adjacent bricks to dispose the flat top portion of the binding member in a flush disposition with the top surfaces of the adjacent bricks.

2. The brick bond of claim 1 wherein the outer shell is formed of reinforced plastic material.

3. The brick bond of claim 1 wherein the inner heat-insulation layer is formed of high density foamed plastic material.

4. The brick bond of claim 1 wherein the outer sealing layer is formed of concrete.

5. The brick bond of claim 1 wherein the binding member is formed of reinforced plastic material.

6. The brick bond of claim 1 wherein:

a) a plurality of elongate grooves of adjacent bricks are aligned in the longitudinal direction and a plurality of elongate grooves of adjacent bricks are aligned in the latitudinal direction;

b) a plurality of binding members engaged within the grooves aligned in the longitudinal direction, with each longitudinally aligned binding member being continuous along the longitudinal extent of the brick bond; and c) a plurality of binding members engaged within the grooves aligned in the latitudinal direction, with each latitudinally aligned binding member being of a length corresponding substantially to the length of a single brick.

7. The bond of claim 5 further including sealing material disposed between the binding members aligned in both the longitudinal and latitudinal directions.

* * * * *